United States Patent [19]

Nikitits et al.

[11] 4,052,100

[45] Oct. 4, 1977

[54] COMBINED FOLDING TABLE AND SEAT ASSEMBLY

[75] Inventors: Edwin Nikitits, Lachine; Jean Guy Demers, Outremont, both of Canada

[73] Assignee: Franklyn M. Markus, Cote St. Luc, Canada

[21] Appl. No.: 693,341

[22] Filed: June 7, 1976

Related U.S. Application Data

[63] Continuation-in-part of Ser. No. 625,695, Oct. 24, 1975, and Ser. No. 683,327, May 5, 1976.

[51] Int. Cl.[2] ..... A47B 83/02

[52] U.S. Cl. ..... 297/159; 297/139; 297/141; 108/35

[58] Field of Search ..... 297/159, 141, 139, 157; 108/35, 36, 113

[56] References Cited

U.S. PATENT DOCUMENTS

| | | | |
|---|---|---|---|
| 404,610 | 6/1889 | Engebretsen | 108/35 |
| 1,967,590 | 7/1934 | Pfluke | 297/139 |
| 2,825,390 | 3/1958 | Post | 297/139 |
| 2,901,304 | 8/1959 | Fihe | 108/35 X |
| 3,266,840 | 8/1966 | D'Estrube | 297/157 |

FOREIGN PATENT DOCUMENTS

| | | | |
|---|---|---|---|
| 988,168 | 8/1951 | France | 297/139 |
| 1,149,740 | 12/1957 | France | 297/139 |

*Primary Examiner*—Roy D. Frazier
*Assistant Examiner*—Peter A. Aschenbrenner
*Attorney, Agent, or Firm*—Hubbell, Cohen, Stiefel & Gross

[57] ABSTRACT

A collapsible combined table and seat assembly, wherein the seats are supported by a leg and the table is supported by members extending between the legs and the ends of the table. The latter members are pivoted on the table and on the legs to permit collapse of the assembly. A sleeve in close fitting sliding relation is mounted on each member to overlie the pivot between the leg and the member to prevent movement at said pivot during use.

19 Claims, 26 Drawing Figures

FIG. 5.
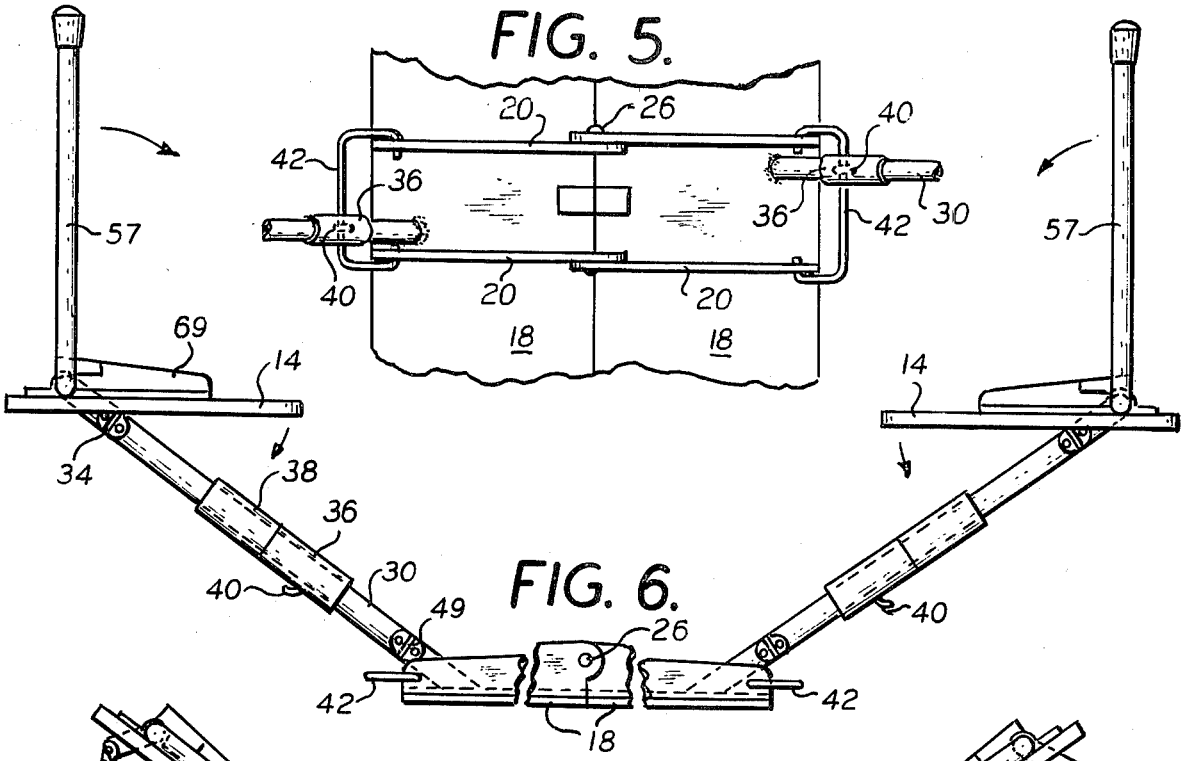
FIG. 6.
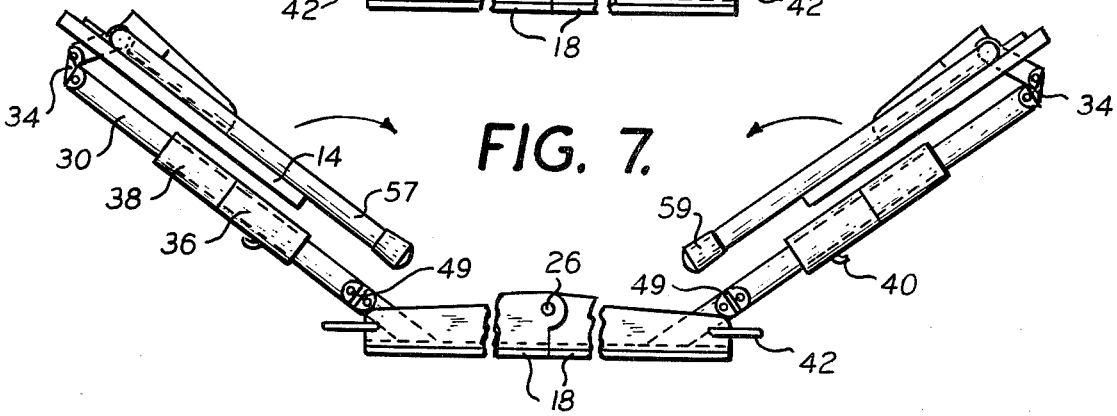
FIG. 7.
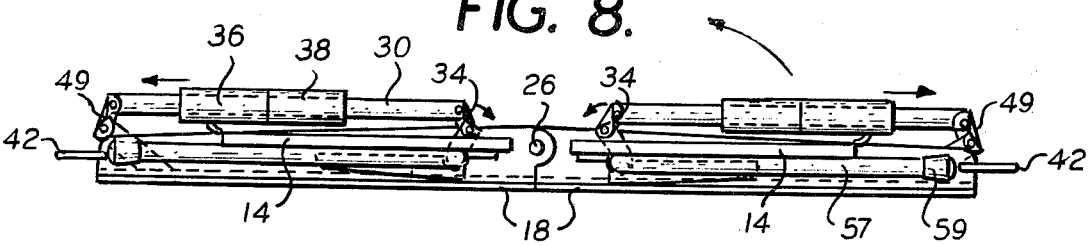
FIG. 8.
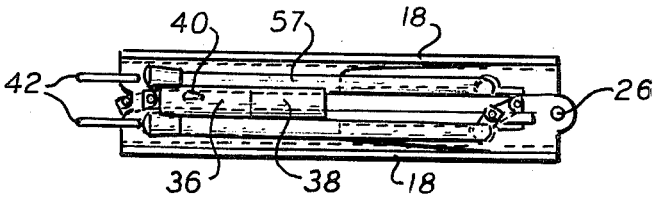
FIG. 9.

12
14
18
20
30
30'
36
38
40
42
42'
55
57
59
80
82
84

COMBINED FOLDING TABLE AND SEAT ASSEMBLY

RELATED APPLICATIONS

This application is a continuation-in-part of our earlier filed application Ser. No. 625,695 dated Oct. 24, 1975 and Ser. No 683,327 filed by the inventors on May 5, 1976, the contents of both of which are hereby incorporated by reference in their entirety.

BACKGROUND OF THE INVENTION

1. Field of the Invention

This invention relates to a combined folding table and seat assembly and particularly to a combined folding table and seat assembly that is collapsible into a self-contained carrying case comprised of the table top. Most particularly, this invention relates to a combined folding table and seat assembly which is collapsible into a case comprised of a folding table top, which assembly, when folded, is readily portable and storable in the trunk of an automobile, or a closet or the like.

2. The Prior Art

As the society has become increasingly mobile through the greatly expanded use of the automobile, more and more families seek to picnic along the side of a road or in a secluded spot. While, often times, prepared picnic facilities are provided, these are generally crowded and are commonly located at sites that are cultivated. Many people prefer to picnic by themselves in more natural surroundings where no dining facilities are available. Also, one often finds no permanent picnic facility at the time he wishes to eat. This generally leads to the use of a picnic blanket or the like which is uncomfortable and often untidy. Thus, there is a growing need for a portable dining facility in the form of a collapsible table and chair assembly.

A similar need has arisen in schools and other public facilities such as conference rooms which use unstructured classroom arrangements. In such arrangements, it is often desirable to clear a room entirely of tables and chairs for certain school activities. To remove standard classroom desks and chairs is an impractical solution to that problem and thus a need for a collapsible chair and desk has arisen.

The need for lightweight and durable collapsible tables and chairs has been recognized for a long time. Thus, for example, in Bassford U.S. Pat. No. 1,272,187 granted on July 9, 1918, a collapsible combined table and seats is disclosed. This Bassford assembly was, by virtue of the nature of the collapsing movements of the various components, relatively large in its collapsed condition. Moreover, there are a number of detachable elements which must be disconnected before collapse is effected and must be connected when operating it to its open position. In U.S. Pat. No. 1,514,418 granted to J. N. Battenfield on Nov. 4, 1924, a combined folding table and seat is disclosed which includes a complex collapsible linkage that is necessarily of substantial weight if it is to have adequate rigidity. Moreover, during the assembly and disassembly of the Battenfield structure, a variety of elements must be disconnected from one another. In the Peterson U.S. Pat. No. 1,641,010, a collapsible table or chair or seat arrangement is disclosed. This arrangement however has a multiplicity of detached separate parts which must be joined to assemble the assembly. This is not convenient and is time consuming. Moreover, because of the number of separate joints in the Peterson device, it is difficult to make such a device rigid without utilizing heavy costly parts. Similarly, in the patent granted to L. Wing on June 11, 1929, U.S. Pat. No. 1,716,612, a collapsible combined table and seat is disclosed. However, the nature of the support of the table on the seats is such as to render the structure somewhat unstable. In Soltesz U.S. Pat. No. Re. 18,207 granted Sept. 22, 1931 still another collapsible combined table and seat is disclosed. This structure requires complex toggle linkages and numerous separate operations for assemblying and disassemblying for combined assembly. Also, the structure precludes access from the sides of the seat, thereby rendering it inconvenient in use. On Oct. 8, 1940, a patent was granted to F. Weber, U.S. Pat. No. 2,217,576, which patent is directed to a collapsible folding table and seat. This device requires complex sliding linkages which would prove to be heavy and costly. In U.S. Pat. No, 2,558,465 granted to P. M. Seymour on June 26, 1951, another combined table and bench assembly is disclosed. This table and bench assembly relies heavily on chainlike tension members for stiffness which members are heavy. Also, the nature of the assembly is such that the table in the Seymour assembly will note be as stable as is required for normal dining use. Likewise, in U.S. Pat. No. 2,647,562 granted to C. F. Hoffar on Aug. 4, 1953, a combined collapsible table and seat assembly is disclosed. However, the Hoffar structure also includes complex linkages and requires a large number of independant operations for opening and closing the assembly. In addition, the Hoffar assembly includes linkages which preclude access from the sides of the benchlike seats and thereby render the assembly difficult to use. Post U.S. Pat. No. 2,991,829 granted on July 11, 1961 likewise discloses a combined collapsible table and seats. This, again, includes complex toggle linkages and requires a variety of separate and distinct operations for opening and closing the assembly. Similar limitations exist in the structures illustrated and described in French Pat. Nos. 1,054,743 and 1,092,230. French Pat. No. 988,168 relies on a flaccid seat which is not wholly rigid in use and the support for the table top is a parallelogram which is inherently less stable than triangular supports. In U.S. Pat. No. 3,141,424 which was granted to P. M. Seymour on July 21, 1964, yet another combined table and seat assembly is disclosed. This assembly does not collapse compactly and it also includes relatively difficult to make cam tracks in its linkage. Finally, in U.S. Pat. No. 3,256,037 granted to J. Giambaldo on June 14, 1966, yet another form of combined table and seat is disclosed. This structure is inconveniently heavy and the linkage employed therein will not yield as rigid a structure as is required.

From the review of the prior art above presented, it will be seen that there have been numerous attempts over many years to produce a lightweight, easily unfolded and folder, combined collapsible table and seat. However, each prior art proposal has fallen somewhat short of the mark. As a result, there has been no significant commercial success for any of the prior art devices known to applicants.

BRIEF DESCRIPTION OF THE DRAWINGS

In the drawings:

FIG. 5 is a fragmentary bottom plan view showing a portion of the table and supports therefor;

FIG. 6 is a side elevational view of the combined table and seat of the present invention in inverted position ready for collapse;

FIG. 7 is a view similar to FIG. 6 showing the combined collapsible table and seat in partially collapsed condition;

FIG. 8 is a view similar to FIG. 6 and 7, but showing the combined collapsible table and seat in still a further step of collapse;

FIG. 9 is a view similar to FIGS. 6 to 8 showing the combined collapsible table and seat in fully collapsed condition;

DETAILED DESCRIPTION OF PREFERRED EMBODIMENTS

Figures 1, 2, 3, 4:
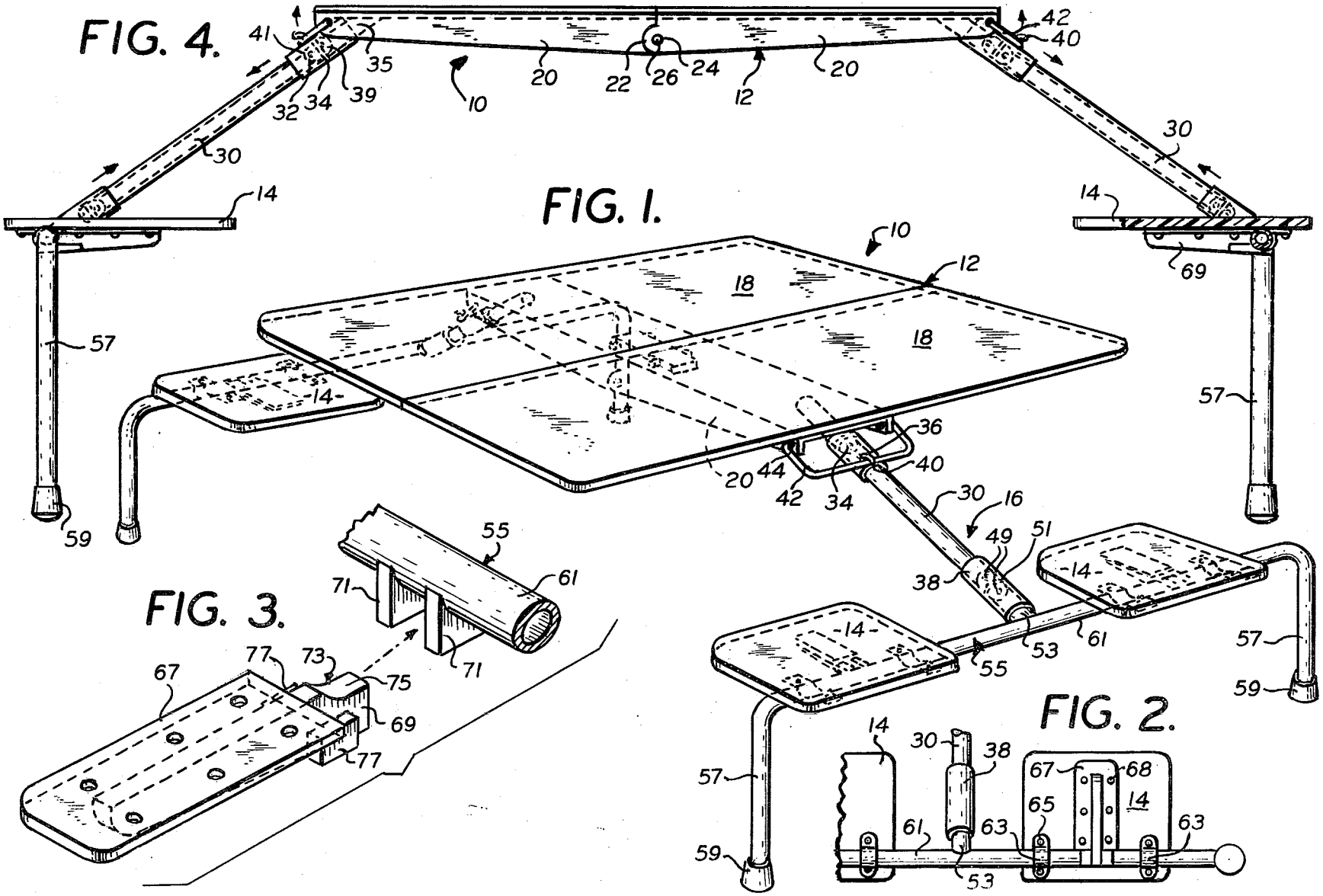
FIG. 1 is a perspective view of the combined collapsible table and seat embodying the present invention.
FIG. 2 is a fragmentary bottom plan view showing the construction of the seats.
FIG. 3 is a perspective view illustrating the seat support and stock mechanism.
FIG. 4 is a view partly in side elevation and partly in section of the table of FIG. 1.

Referring now to the drawings in detail and particularly to FIGS. 1 and 4 thereof, a collapsible combined table and seat assembly 10 embodying the present invention is illustrated in its unfolded or usable condition. The assembly 10 comprises a collapsible table 12 and two pairs of seats 14, one pair on each side of the table. The seats may be made of any material, preferably lightweight, such as wood, metal, and plastic which is formed or unformed and reinforced or not reinforced. As will be more fully dealt with subsequently in this description, the invention contemplates structures having seats on only one side of the table as well as on both sides of the table and further contemplates structures wherein there are a different number of seats than two on each side of the table. Thus, there could be three seats on one side of the table or on both sides of the table or, as shown subsequently with respect to the embodiment in FIG. 17, there could be one on each side of the table or as shown in FIG. 18, there could be one on one side of the table and none on the other. The seats 14 are connected to the table 12 by a suitable lightweight collapsible linkage 16, which linkage in its illustrated position provides a rigid support for the seats 14 and for the table 12. As will become more apparent hereinafter, included in the linkages 16 are the supports for the seats 14.

The table 12 is comprised of two relatively pivotally movable top portions 18 which may be made of any suitable material such as, for example, wood, sheet metal such as sheet aluminum, fiberboard, and, as presently preferred, fiber glass reinforced plastic. Preferably, the material is lightweight and to this end composite structures such as honeycomb cores may be employed. Among materials which may be useful for forming the table 12 are materials formed by foam injection molding. Such materials may be polystyrene, polycarbonate, polyvinylchloride, low molecular weight polyethylene, polypropylene, or other similar materials capable of being employed for structural foam injection molding. Such materials and the process of foam injection molding are described in the following U.S. patents, the contents of which are hereby incorporated by reference in their entireties: U.S. Pat. Nos. 3,058,161; 3,211,605; 3,268,636; 3,384,691; 3,436,446; 3,599,290; 3,674,401, and 3,746,492.

Extending along both sides of a central portion of each of the two foldable table portions 18 are downwardly extending reinforcing struts or ribs 20 which overlap at the center of the table 12 and are provided in the zone of overlap which is designated by the reference numeral 22 with registered apertures 24 through which extend suitable pivots in any suitable form such as, for example, screws 26 or rivets or the like. When the assembly 10 is conditioned for collapse, the two table top portions 18 can be pivoted relative to one another from the open position illustrated in FIGS. 1 and 4 in which they are in co-planar end-to-end relation and to a closed position in which they are in parallel spaced apart confronting relation as may be seen in FIGS. 9 and 10. As viewed in FIG. 4, the movement of the left hand tabletop portion 18 to collapse the table 12 would be counterclockwise and the movement of the right hand tabletop portion 18 would be clockwise. This would bring the two tabletop portions 18 into their closed position in which they are in spaced apart confronting relation, as will be described in greater detail hereinafter. The struts or ribs 20 may be formed separately from the tabletop portions 18 and joined thereto in any suitable manner such as by the use of adhesives or by the use of securing elements, such as screws or the like. In such instance, wood or metal or plastic may be employed. In lieu thereof, each tabletop portion may be formed of a fibreglass reinforced plastic material or from sheet aluminum in which event the struts 20 may be formed integrally with the tabletop portion 18. A similar integral construction could be employed if the materials are formed by foam injection molding. While it is preferred that the ribs 20 be disposed adjacent the center of the table 12, it will be recognized that they may be disposed outwardly from the center and even along the outer side edges thereof as is shown and described in the parent applications heretofore referred to. If further stiffening of the tabletop is required or desired, it may be provided by a plurality of reinforcing ribs extending longitudinally or transversely thereof, as along the central portion thereof.

The linkages 16 each include a downwardly angularly sloping central support member 30 which may be of metal, wood, plastic or other lightweight rigid material. The upper end of the support members 30 are pivotally connected as at 34 to a downwardly extending stud 35 secured to the bottom of the table portion 18 in any suitable manner. As shown, the member 35 is cylindrical in configuration and is disposed to be in alignment with the member 30 when the member 30 is in its unfolded position shown in FIGS. 1 and 4. Of course, other means for providing an abutment for the pivotal mounting 34 may be provided within the scope of this invention. As shown, the pivotal mounting 34 comprises two separate pivots 32 and 39 between which extends on each side of the member 30 a strap 41. While this is preferred it is not required for the practice of this invention. The opposite or lower end of the support member 30 is pivotally mounted to a cyclindrical abutment 53 which extends upwardly and inwardly from the U-shaped seat support 55 in alignment with the member 30 when the article 10 is in its unfolded position.

To prevent the inadvertent collapse of the linkage 16 from its open position as illustrated in FIGS. 1 and 4, a pair of sleeves 36 and 38 are slidably mounted on the member 30 for movement between locking positions shown in FIGS. 1 and 4 wherein they bridge the pivotal connection between the members 30 and the two supports 35 and 53 and to an unlocked or pivoting position shown in FIG. 7 in which both sleeves 36 and 38 are slid inwardly towards the center of the member 30 and out of overlapping condition with the pivots. In the latter position, a collapsing motion can be effected as will be described hereinafter.

As shown, sleeve 36 has an upwardly extending hook 40 which is engagable by a U-shaped handle 42 that is pivotally mounted on the stiffening ribs 20 as at 44 for holding the sleeve 36 in its locked position. Clearly, gravity will hold the member 38 in its locked position. To unlock the sleeve 36 for downward sliding movement as used in FIG. 1, all that need be done is to pivot the handle 42 upwardly about its pivot 44 whereby to unhook it from the hook 40 to thus free the sleeve 36 for downward movement.

As will be described in greater detail hereinafter, other means may be employed for holding the sleeves in their locked position, such as a compression spring (see FIG. 13) or the reliance on a bayonet joint for both sleeves 36 and 38. Irrespective of which means for holding the sleeves in their locked position are employed, it will be obvious that the sleeves should have a close sliding fit about the members 30 whereby to prevent any shaking at the joints 34 and 49 when the assembly 10 is in its open position as shown in FIGS. 1 and 4. It will also be obvious that it is not necessary for the practice of the present invention that the member 30 and its abutments 35 and 53 and the sleeves 36 and 38 all be of cyclindrical configuration. It will be obvious that other cross-sectional shapes such as, for example, rectangular cross-sections may be employed in this regard and such may be preferable from a structural viewpoint.

As already noted, the seats 14 are supported by a U-Shaped seat support member 55, the legs 57 of which extend downwardly in the unfolded position and may be provided with cushioning caps 59 at the bottom ends thereof. The seats 14 are pivotally mounted on the bit or horizontal portion 61 of the U-shaped seat support member 55. The manner of mounting the seats 14 is best illustrated in FIG. 2 which shows the bottom of each of the seats 14 provided with U-shaped straps 63 that fit around the horizontal portion 61 with clearance to provide pivotal mounting. The straps 63 are secured to the bottom of the seats 14 in any suitable manner such as, for example, adhesives, screws or as shown herein rivets 65. Clearly, other means for pivotally mounting the seats 14 on the horizontal portion 61 may be employed.

Stop means are provided for holding the seats 14 in the horizontal position shown in FIGS. 1 and 4 when the assembly is in its unfolded condition. The presently preferred stop means is illustrated best in FIG. 3. A plate 67 is secured to the bottom of its seat 14 in any suitable manner as by screws 69 or the like. If desired, to stiffen the seat 14, a depending rib 69 may be provided along the central axis of the plate 67. Secured to the horizontal portion 61 of the inverted U-shape leg member 55 at each seat location is a stop 71, here shown as a pair of stops 71, which are spaced apart to receive therebetween the rear portion of the reinforcing rib 69, which portion is designated by the reference numeral 73 and is provided in its upper edge with an arcuate surface 75 complementary to the periphery of the leg member 55. With respect to the seat 14 at the right hand side of FIG. 4, it will be obvious that it cannot be pivoted in a counterclockwise direction beyond the position in which it is illustrated, that is the horizontal position. In that position, the rear end of the plate 67 engages the forward edge surfaces of the stops 71 to thus prevent any further rotational movement in the counterclockwise direction. In that position, with the rib portion 73 disposed between the stops 71, there can be little or no lateral movement of the seat 14. If desired, this limitation on lateral movement can be further enhanced by providing a stop block 77 along one of the edges of the plate 67 spaced from the confronting surface of a rib a distance slightly larger than the thickness of one of the stops 71, whereby to sandwich that stop between the block 77 and the rear portion 73 of the rib when the seat is in its open or horizontal position. In this manner, the seat is held in its illustrated open position. However, when it is desired to fold the seat away, all that need be done, again with reference to the right hand seat 14 in FIG. 4 is to rotate the seat in a clockwise direction 270 degrees to bring the seat into co-planar relation with the vertical portions 57 of the inverted U-shape leg member 55.

As may best be seen in FIG. 6, the next step preferably performed in the folding or closing of the article 10 is to slide the sleeves 34 and 38 inwardly on member 30 whereby to free the two pivots 34 and 49 to permit the collapse of the seats into the table 12. In order to achieve this, the handles 42 must be unhooked from the hooks 40 on the sleeves 38 to permit the sleeves to be slid inwardly towards the center of the member 30.

Once the sleeves are moved to the center portion of the member 30, and with the seats 14 pivoted into coplanar relation with the legs 55, the seats and legs together may be pivoted about the pivots 34 to bring them into parallel relation with the members 30. This condition is shown in FIG. 7 of the drawings. As illustrated in FIGS. 7 and 8, the members 30 can now be pivoted about their pivots 49 from the position shown in FIG. 7 in the direction of the arcuate arrows in FIG. 7 to the position shown in FIG. 8 wherein the legs 55 and the seats 14 and the members 30 lie in parallel relation with the tabletop 12. Once in that position, then the two tabletop halves 18 can be pivoted about their pivot 26 in the direction of the arcuate arrow in FIG. 8 whereby to bring the table into the condition shown in FIG. 9 and 10 with the two tabletop halves 18 in spaced apart parallel confronting relation with the remainder of the collapsed structure in between to enable the entire assemblage to be carried by handles 42 in the manner of a piece of luggage.

While the embodiment of the invention described in FIGS. 1–10 shows the support members 30 as cylindrical rods, it should be appreciated that the members 30 can be of any desirable cross-section without departing from this invention. Specifically, a rectangular or square cross-section or perhaps a star-shaped cross-section could prove desirable in connection with the present invention. Of course, the sleeves surrounding the rods will have a complementary internal cross-section.

Figures 10, 11, 12, 13, 14:
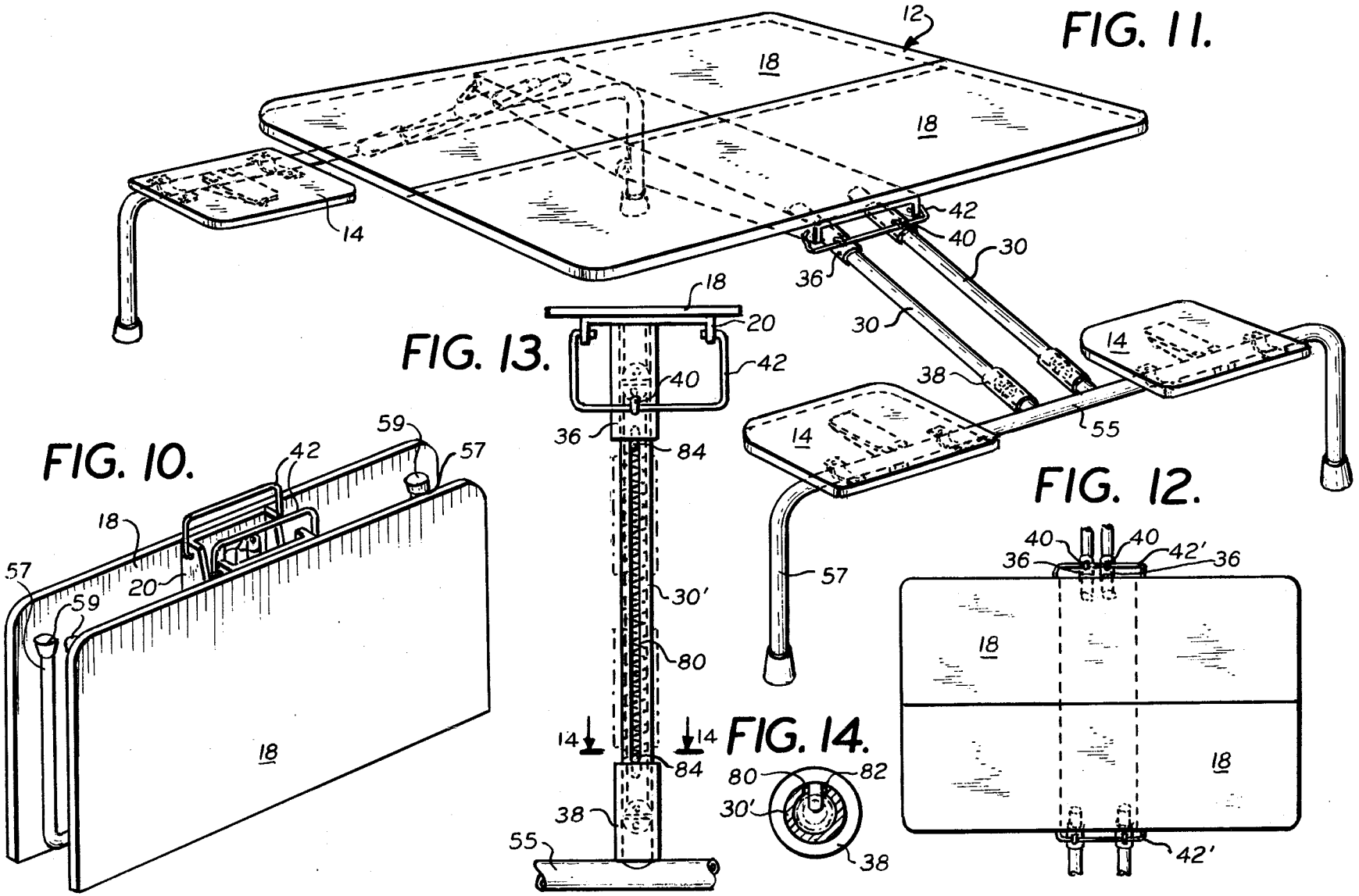
FIG. 10 is a perspective view of the combined collapsible table and seat in fully collapsed condition.
FIG. 11 is a perspective view similar to FIG. 1 showing a modified form of combined collapsible table and seat embodying the present invention.
FIG. 12 is a fragmentary top plan view of the combined collapsible table and seat of FIG. 11 showing the table and supports therefor.
FIG. 13 is a view of a modified form of a table support with certain parts deleted to more easily illustrate other features thereof.
FIG. 14 is a sectional view taken along the line 14—14 of FIG. 13.

Similarly, with reference to FIG. 11, a modified form of the invention is shown wherein each of the legs 55 is in supporting relation with the table 12 by means of two rods 30 on each side, rather than the one rod 30 of the FIGS. 1–10 embodiment. This will increase the transverse stability of the table. Apart from that, the structure shown in FIGS. 11 and 12 is in all respects identical to the structure of the earlier described embodiment it being appreciated, as illustrated in FIG. 12, that the handles 42' are somewhat longer than the handles 42 in order to hook two hooks 40, that is one on each of the sleeve members 36, to hold those sleeves in their locking position when desired.

Referring now to FIGS. 13 and 14, if desired, means may be provided for biasing the sleeves 36 and 38 to their locking or extended positions. Such means may comprise a compression spring 80 disposed within a hollow tubular member 30' having a longitudinal slot 82 therein. Extending through the slot 82 and into engagement with the spring 80 is a pin 84 for each of the sleeves 36 and 38. The pins are in engagement with the spring 80 which operates to push the pins and hence the sleeves 36 and 38 outwardly away from one another and into the locking position shown in FIG. 13. When it is desired to unlock the assemblage shown in FIG. 13, the sleeves must be pushed toward one another against the bias of the spring 80 until the sleeves have cleared the underlying pivots 34 and 49 to permit collapse of the assemblage. When, however, the assembly is to be opened from its collapsed position, as the member 30' moves into alignment with the studs 35 and 53 the sleeves will automatically move outwardly into locking position relative to the pivots under the urging of the spring 80. Thus this will be automatically effected upon opening.

Figure 15:
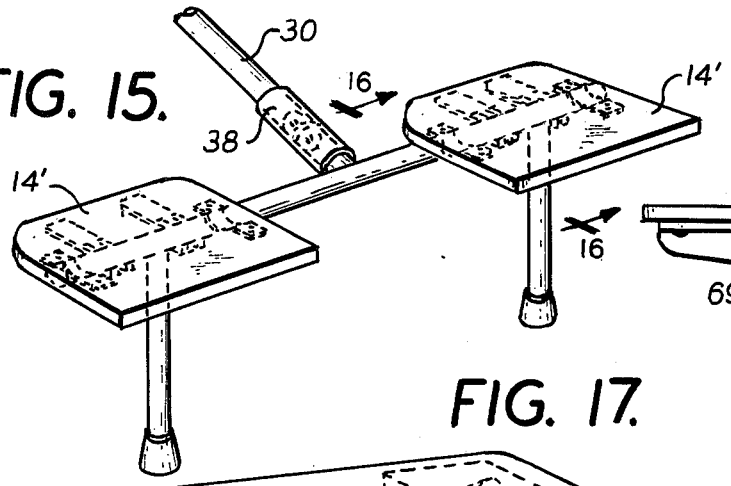
FIG. 15 is a fragmentary perspective view showing a modified form of collapsible seat and supports therefor.
Figure 16:
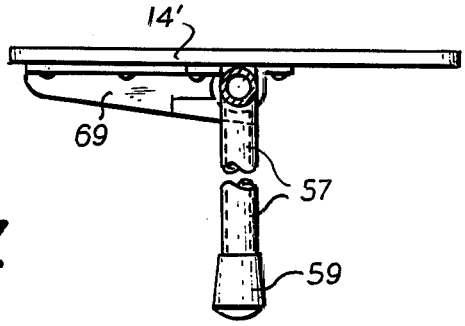
FIG. 16 is a sectional view taken along the line 16—16 of FIG. 15.

It will be appeciated that the seats 14 need not be cantilevered as shown in, for example, FIG. 1. Instead, if desired, the seats may be pivoted about their central axis as shown in FIGS. 15 and 16 whereby to significantly reduce the load on the stop means shown in FIG. 3. In addition, if desired, two underlying bracket-type supports may be employed with each of the seats 14' of FIGS. 15 and 16 and a similar dual arrangement could be employed in connection with the other embodiments of this invention.

Figure 17:
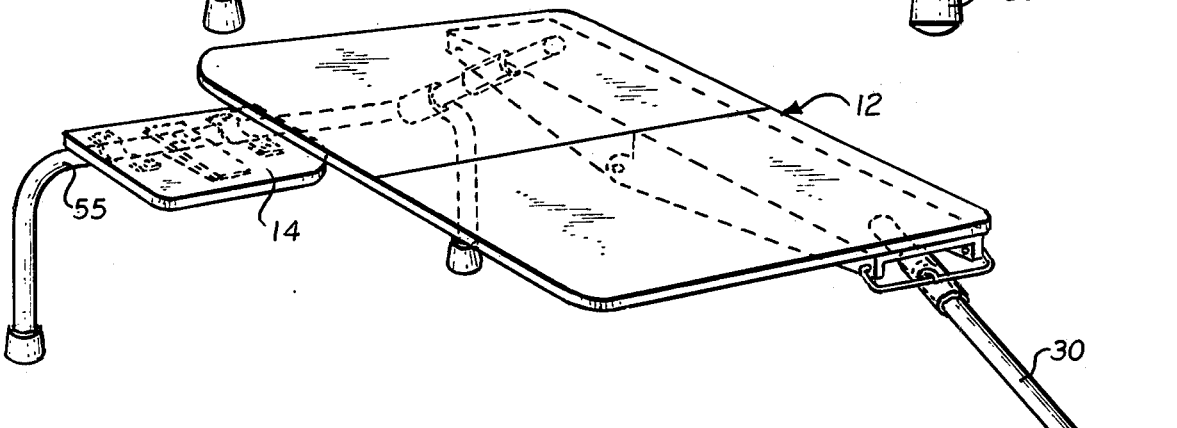
FIG. 17 is a perspective view similar to FIG. 1 showing another modification thereof.
Figure 18:
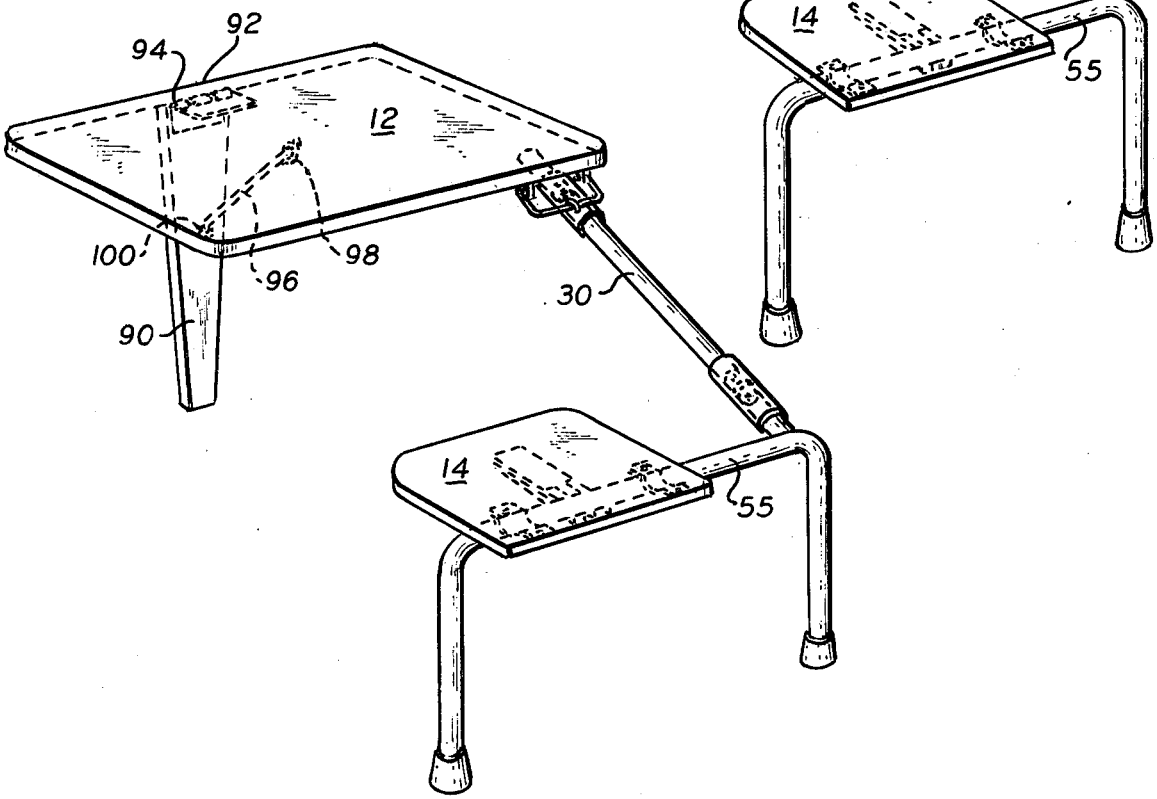
FIG. 18 is a perspective view similar to FIG. 1 showing yet another modification thereof.

Turning our attention now to FIG. 17, it will be apparent that the number of seats 14 to be supported on the leg 55 need not be two. Instead, any number may be employed, such as, for example, one on each side as shown in FIG. 17. In addition it will be recognized that, for example, three seats may be supported on a long U-shaped leg 55 and when such is done it is preferable that the members 30 be attached to the U-shaped member 55 between two seats rather than at one end, whereby to permit access to seats from both sides.

Referring now to FIG. 18, it is possible, and perhaps desirable for certain applications such as school-room applications, that a seat 14 be provided on only one side of a table 12 rather than on both sides. When that is done, it is obvious that there will be a U-shaped leg 55 underlying the seat in its open position and a collapsible link 30 extending from the leg to the table 12 to support one side. However, there is no similar structure on the opposite side of table 12. To compensate for this lack of supporting structure that side of the table must be wall mounted or the like or some form of collapsible leg 90 must be employed which leg 90 is shown in FIG. 18 to be of a length equal to the width of the table 12 so that it can be folded thereunder. The leg 90 is shown connected to the opposite side 92 of the table 12 from the side to which the member 30 is pivotally connected. Preferably a suitable pivot-type connection such as a hinge 94 is employed to effect the connection between the leg and the table. To hold the leg 90 in its open or extended position as shown in FIG. 18, the leg 90 is connected to a suitable brace 96 here shown to be a rod which may be pivotally connected to the bottom of the table 12 by a pair of inter-hooked eyes 98 and detachably connected to the leg as by a hook-and-eye 100. Obviously, the form of connection is merely illustrative and clearly the rod-like brace 96 could be permanently secured to the leg 90 and releasably connected to the botom of the table 12, if desired.

Figures 19, 20, 21, 22, 23, 24, 25:
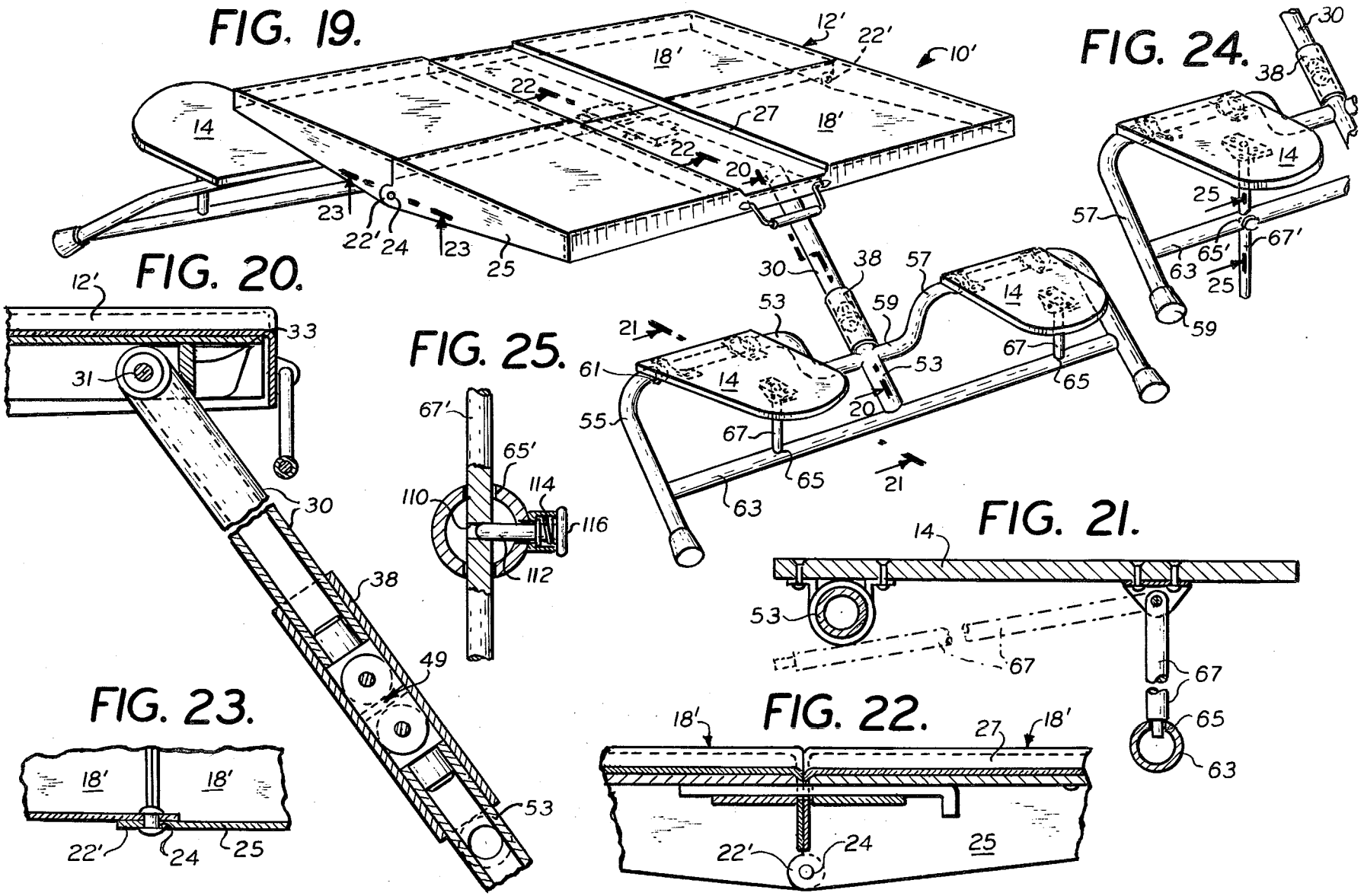
FIG. 19 is a perspective view similar to FIG. 1 showing still a further modification thereof.
FIG. 20 is a sectional view taken along the line 20—20 in FIG. 19.
FIG. 21 is a sectional view taken along the line 21—21 in FIG. 19.
FIG. 22 is a sectional view taken along the line 22—22 in FIG. 19.
FIG. 23 is a sectional view taken along the line 23—23 in FIG. 19.
FIG. 24 is a fragmentary perspective view of yet another form of collapsible seat which can be employed in any of the modifications of the present invention.
FIG. 25 is a sectional view taken along the line 25—25 in FIG. 24.

Referring now to FIGS. 19–23, yet another form of the present invention is shown wherein the table 12' is made of two collapsible halves 18' which are joined together by pivots 22' which extend through aligned apertures 24' in a downwardly extending rib or skirt 25. As shown, the downwardly-extending skirts also extend along the sides of each of the members 18' whereby to provide considerable additional stiffness for these plate-like members. Thus, a relatively light gauged aluminum may be employed in the FIG. 19 embodiment rather than plastic, reinforced or unreinforced, wood or the like. If desired, further stiffening can be accomplished as by providing a central groove 27 in each of the table top members 18'. Extending downwardly from each of the sides of the table 12' is a suitable support member 30' which member is pivotally connected as at 31 to the bottom of the table 12' the pivot being located centrally of the table 12' in the vicinity of the groove 27, for example. Means are provided to serve as a stop for the pivotal movement of the member 30 outwardly from its folded to its open condition. This means may be provided within the pivot structure itself or it may be a downwardly-extending member 33 fixed to the bottom of table 12' and engageable by member 30 for limiting the outward movement of that member. In this connection it should be noted that the stop 33 serves as a limit to the extent of pivotal movement of the member 30 in this embodiment, there being no upper sleeve to perform this function. However, the lower pivot 49 which connects the member 30 with stud 53 does cooperate with a sleeve 38 for limiting or preventing pivotal movement in the open condition. If desired a suitable biasing means may be included for releasably holding sleeve 38 in the position shown in FIG. 20. The seats 14 in the embodiment 10' of FIG. 19 are supported by a U-shaped member 55 wherein the horizontal cross-piece 57 is shown with an optional inverted U-shaped depression 59 at the center. The seats 14 are pivotally mounted as by straps 61 secured to the underside of the seats and rotatably mounted about the two horizontal portions of the upper part of the U-shaped leg 55. The leg 55 extends downwardly at an angle to the horizontal, preferably the same angle as members 30, and is also provided with a cross-piece 63 near the bottom of the member which cross-piece provides connecting means in the form of apertures 65 in the upper element thereof, which apertures are proportioned to receive therewithin the lower ends of pivoted support rods 67 which are pivotally mounted on the bottoms of the seats 14. (See FIG. 21). Thus, to collapse the seats 14 in the FIG. 19 embodiment, the seats 14 must be first pivoted upwardly whereby to withdraw the bottoms of the rod 67 from the aperture 65 whereupon the rod 67 may be swung inwardly parallel to the seats 14 and the seats 14 may be pivoted downwardly to come to rest against the cross-piece 63. Thereafter the collapsing of the FIG. 19 embodiment will be apparent from the preceding discussion.

The FIG. 19 embodiment is also provided with a suitable stop means for orienting the two tabletop halves 18' coplanar when desired. This means may form a part of the surrounding skirt 25 on each of the parts 18' which skirt portions will come into abuting relation when the table is in its unfolded condition (FIG. 22).

Referring now to FIG. 25, a seat of the type shown in FIG. 19 is illustrated wherein a modified form of rod 67' is provided. In the FIG. 25 modification, the rod is portioned to have the lower end thereof coplanar with the bottom 59 of the U-shaped leg 57 when the seat 14 is horizontal. This will provide for additional stability and strength for the seat. To releasably hold the rod 67' in the described position, the rod is provided with an aperture 110 which registers with the tubular cross-piece 63 when the rod 67' is in position to hold the seat 14 horizontal. When so located the aperture 110 will be in register with a pin-like detent 112 that is spring-biased by a compression spring 114 toward the rod 67'. This will releasably hold the rod in the illustrated position.

However, when it is desired to fold away the table, the knob-like end 116 of the pin 114 is pulled or retracted whereby to remove the pin 112 from the aperture 110 against the bias of the spring 114 whereby to free the rod 67' for upward movement. It may then be moved upwardly by swinging the seat 14 upwardly until it is withdrawn from the aperture 65' in the cross-piece 63 for the seat support. Thereafter it may be folded up as shown in FIG. 21 about the pivot and the seat may be collapsed as described in connection with FIG. 19.

Figure 26:
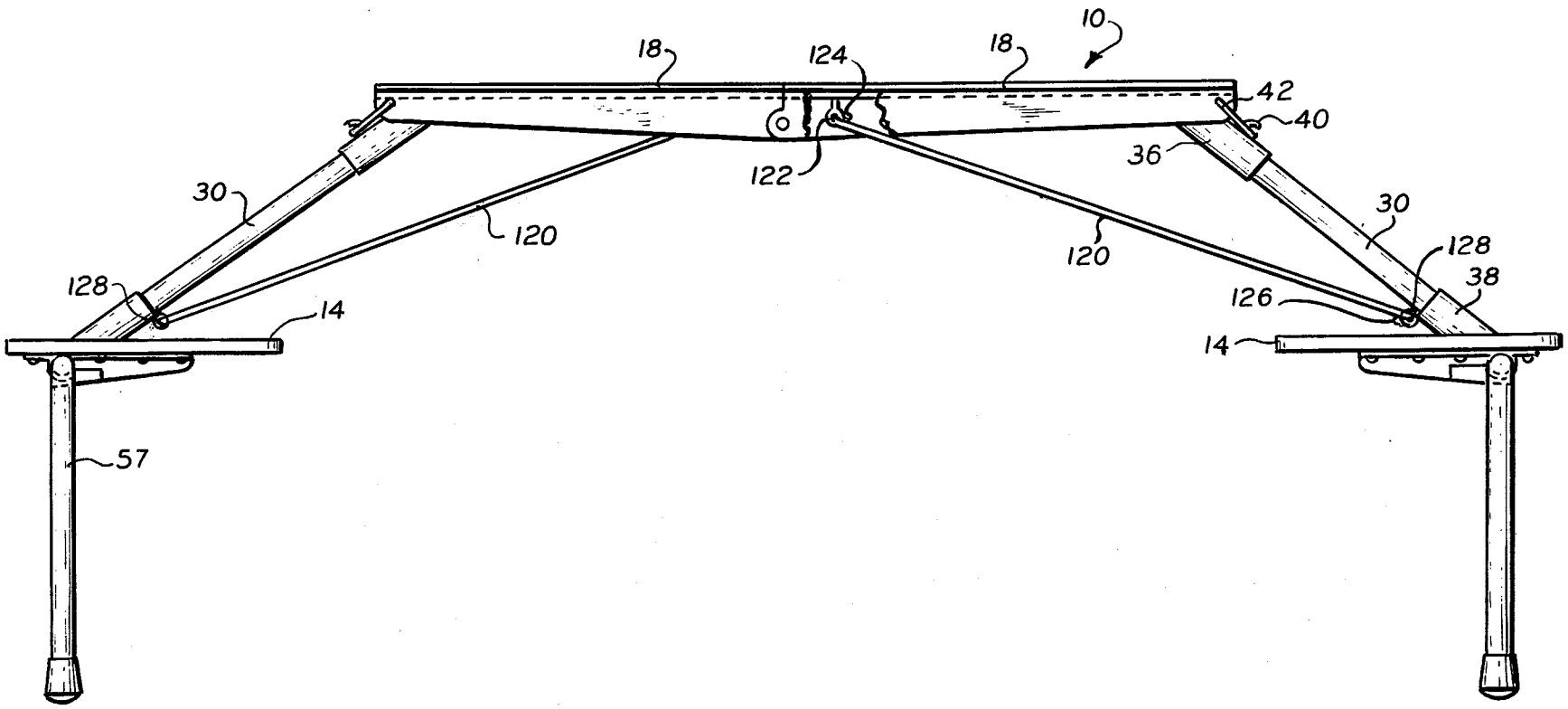
FIG. 26 is a view similar to FIG. 4, showing yet another modification.

Referring now to FIG. 26, the collapsible table and seat assembly 10 which, for illustrative purposes, is essentially identical to that shown in FIGS. 1 and 4 is illustrated. However, this device includes an additional brace to further rigidify the structure in its open condition. Specifically, an angle brace 120 extends from each of the table top portions 18 to a point on the rod 30 adjacent the leg 55 to form a triangular bracing arrangement when the device is in its open condition as shown in FIG. 26. With reference to FIG. 26, the rod 120 is provided with an eye-like end 122 that is interconnected with an eye 124 secured to the bottom of the associated tabletop portion 18. The other end of the rod 120 is provided with a hook 126 that fits into an eye 128 near the bottom of the rod 30. As shown for illustrative purposes herein, the eye 128 is actually connected to the sleeve 38 to thus hold the sleeve in the illustrated position. Once the table is placed in its open condition the rod 120, which generally lies folded transversely of the table axis, is swung down to permit hook 126 to be hooked into the eye 128 and thereby complete the rigid triangular bracing structure. This form of bracing was previously described in the parent application which has already been incorporated by reference. It may be employed with all forms of the present invention.

The foregoing embodiments of the invention have all been described in terms of collapsible combined table and seat assemblies for use by adults or children. Such use is clearly desirable and the permutations and combinations of uses for recreation, household, school, institution and office are myriad. In addition, and within the contemplation of this invention, these assemblies may also be used as playthings, for example, when scaled down to a size suitable for doll furniture.

While we have shown and described the preferred form of the present invention and have suggested modifications therein, other changes and modifications may be made therein within the scope of the appended claims without departing from the spirit and scope of this invention.

What is claimed is:

1. In a collapsible combined table and seat of the type wherein said seat and table are relatively pivotally movable between an open position wherein said table and seat are horizontal and the front edge of said seat is disposed adjacent and below one end of said table and a folded position wherein said seat is in confronting substantially parallel relation with said table, an improved collapsible linkage for supporting said table and seat in said open position and for permitting said pivotal movement to said folded position, said linkage comprising:

a support member, a pivot for connected one end of said support member to said table adjacent said one end of said table for movement between an open position in which said support member extends downwardly from said table and a closed position in which said support member is in confronting parallel relation with the bottom surface of said table;

a leg, another pivot for connecting said leg to the end of said support member opposite said one end thereof for movement between an open position in which said leg extends downwardly from said support member and a closed position in which said support member and said leg are in confronting substantially parallel relation;

said seat being pivotally mounted on said leg for movement between an open position in which said seat extends horizontally from said leg when said leg and said support member are in their open position and a closed position in which leg and said seat are in confronting substantially parallel relation; means for holding said seat in said open position; and a longitudinally extending sleeve slidably mounted on said support member for movement between an unlocking position wherein said sleeve is out of overlapping relation with said other pivot to permit pivotal movement between said support member and said leg and a locking position wherein said sleeve overlies said other pivot to prevent movement thereabout.

2. The assembly of claim 1, further comprising a second sleeve slidably mounted on said support member for movement between an unlocking position in which said second sleeve is out of overlying relation with said first pivot and a locking position in which said second sleeve is in overlying relation with said first pivot to prevent movement thereabout, and means for holding said second sleeve in said locking position.

3. The assembly of claim 2, wherein said holding means comprises a handle pivotally mounted adjacent the end of said table, and a hooked protrusion on said second sleeve engageable by said handle when said second sleeve is in said locked position.

4. The assembly of claim 2, wherein said holding means comprises a spring.

5. The assembly of claim 4, wherein said spring is a compression spring engaging both said sleeves, whereby said spring further functions to automatically move said sleeves into their locked position.

6. The assembly of claim 1, further comprising a second support member pivotally mounted on said table top and extending parallel to said first-mentioned support member, a pivot for connecting said second support member to said leg member, and another sleeve, said other sleeve being slidably movable on said second support member between a locking position overlapping said last-mentioned pivot and an unlocking position out of overlapping relation with said last-mentioned pivot.

7. The assembly of claim 1, wherein said table comprises two like table portions, and means for pivotally connecting said two table portions for movement between an open position in which said two table portions are in end-to-end co-planar relation and a closed position in which said two table portions are in substantially parallel spaced apart confronting relation, and wherein there is a seat for each end of said table, and wherein there is an improved collapsible linkage connecting each one of said seats to the adjacent one of said table portions.

8. The assembly of claim 1, further comprising a rigid leg pivotally mounted on said table adjacent said other end for movement to an open position in which said rigid leg depends from said table and to a closed position in which said rigid leg is in parallel confronting relation with said table.

9. The assembly of claim 8, further comprising a collapsible brace operable to a bracing position in which it rigidly extends between the bottom of said table and a point on said leg intermediate its two ends at an angle to both for preventing relative pivotal movement between said rigid leg and said table, and a non-bracing position to permit relative pivotal movement between said table and said rigid leg.

10. The assembly of claim 1, wherein said leg is an inverted U-shape, said other pivot connects said support member to the horizontal portion of said inverted U, and said seat is pivotally mounted on the horizontal portion of said inverted U.

11. The assembly of claim 10, wherein there are two seats on said leg, and said other pivot is located between said seats.

12. The assembly of claim 10, wherein said seat is cantilevered out from said leg, and stop means for preventing pivotal movement of said seat beyond the horizontal.

13. The assembly of claim 10, wherein said seat is pivoted along substantially its central transverse axis, and stop means for preventing pivotal movement of said seat beyond the horizontal.

14. The assembly of claim 12, wherein the seat pivot is located adjacent the rear edge of said seat.

15. The assembly of claim 12, wherein the seat pivot is located adjacent the front edge of said seat.

16. The assembly of claim 15, further comprising a rod pivotally connected to the bottom of said seat adjacent the rear and orientatable vertically when said seat is horizontal for bracing the rear of the seat.

17. The assembly of claim 1, further comprising a brace pivotally mounted on said table at a location away from an end thereof and connectable to said support member for bracing said linkage.

18. The assembly of claim 1, further comprising a brace pivotally mounted on said table at a location away from an end thereof and connectable to said leg for bracing said linkage.

19. The assembly of claim 1 wherein said seat comprises a rigid substantially planar member and wherein said seat open position comprises said seat being cantilevered out from said leg.

* * * * *